US006541158B2

(12) United States Patent
Frysz et al.

(10) Patent No.: US 6,541,158 B2
(45) **Date of Patent: *Apr. 1, 2003**

(54) COBALT-BASED ALLOYS AS POSITIVE ELECTRODE CURRENT COLLECTORS IN NONAQUEOUS ELECTROCHEMICAL CELLS

(75) Inventors: Christine A. Frysz, New Milford, CT (US); Sally Ann Smesko, North Tonawanda, NY (US); Peter A. Kreidler, Oakfield, NY (US); W. Richard Brown, Clarence Center, NY (US); Esther S. Takeuchi, East Amherst, NY (US)

(73) Assignee: Wilson Greatbatch Ltd., Clarence, NY (US)

( * ) Notice: Subject to any disclaimer, the term of this patent is extended or adjusted under 35 U.S.C. 154(b) by 11 days.

This patent is subject to a terminal disclaimer.

(21) Appl. No.: 09/903,637

(22) Filed: Jul. 12, 2001

(65) Prior Publication Data

US 2002/0051909 A1 May 2, 2002

Related U.S. Application Data

(63) Continuation-in-part of application No. 09/257,795, filed on Feb. 25, 1999, now Pat. No. 6,306,544.

(51) Int. Cl.[7] ..... H01M 4/72; H01M 4/58

(52) U.S. Cl. ..... 429/233; 429/233.1; 429/218; 429/218.1

(58) Field of Search ..... 429/218, 218.1, 429/233, 233.1; 29/623.1–623.5

(56) References Cited

U.S. PATENT DOCUMENTS 3,904,402 A 9/1975 Smashey ..... 75/170
4,012,564 A 3/1977 Auborn ..... 429/194
4,084,669 A * 4/1978 Suwa et al. ..... 191/45 R
4,154,906 A 5/1979 Bubnick et al. ..... 429/94
4,167,468 A 9/1979 Juckniess et al. ..... 204/247

(List continued on next page.)

OTHER PUBLICATIONS

Standard Specification for Wrought Cobalt–Nickel–Chromium–Molybdenum–Tungsten–Iron Alloy For Surgical Implant Applications; pp. 102–104; Designation F563–88.

Standard Specification for Wrought Cobalt–Nickel–Chromium–Molybdenum–Tungsten–Iron Alloy For Surgical Impant Applications; pp. 99–101; Designation F562–92.

Standard Specification for Wrought Cobalt–Nickel–Chromium–Molybdeum–Tungsten–Iron Alloy For Surgical Implant Applications; pp. 11–13; Designation F90–92.

Corrosion of Current Collectors in Li/$CF_x$–Elements, S.A. Fateev; O.O. Denisova; I.P. Monakhova, E.H. Lubnin and T.R. Agladze; pp. 219–220.

Chemical Abstracts, vol. 96, No. 4, Jan 25, 1982 Columbus, Ohio, US; abstract No. 25832, Skaggs, Lester S. et al: "Experience with thin Havar foils for cyclotron target windows" XP002140171 *abstract* & Prep. Nucl. Targets Part. Accel., 'Proc. World Conf. Int. Nucl. Target Dev. Soc.! (1981) Meeting date 1979, 249–68. Editor(s): Jaklovsky, Jozef. Publisher: Plenum, New York, N.Y. 1981.

*Primary Examiner*—Tom Dunn
*Assistant Examiner*—L. Edmondson
(74) *Attorney, Agent, or Firm*—Michael F. Scalise

(57) ABSTRACT

Cobalt-based alloys are provided for use as a positive electrode current collector in a solid cathode, nonaqueous liquid electrolyte, alkali metal anode active electrochemical cell. The cobalt-based alloys are characterized by chemical compatibility with aggressive cell environments, high corrosion resistance and resistance to fluorination and passivation at elevated temperatures, thus improving the longevity and performance of the electrochemical cell. The cell can be of either a primary or a secondary configuration.

25 Claims, 10 Drawing Sheets

U.S. PATENT DOCUMENTS 4,216,275 A * 8/1980 Hartmann et al. ..... 429/104
4,255,247 A 3/1981 Oda et al. ..... 204/293
4,400,211 A 8/1983 Kudo et al. ..... 420/443
4,508,608 A 4/1985 Palmer ..... 204/192
4,520,083 A 5/1985 Prater et al. ..... 429/101
4,585,715 A 4/1986 Marple ..... 429/194
4,737,423 A * 4/1988 Tung ..... 429/231.7
4,770,956 A * 9/1988 Knodler ..... 429/104
4,830,940 A 5/1989 Keister et al. ..... 429/194
5,037,712 A 8/1991 Shackle et al. ..... 429/129
5,051,233 A 9/1991 Horn et al. ..... 420/50
5,053,297 A 10/1991 Yamahira et al. ..... 429/194
5,114,810 A 5/1992 Frysz et al. ..... 429/194
5,147,739 A 9/1992 Beard ..... 429/194
5,187,033 A 2/1993 Koshiba ..... 429/194
5,399,438 A 3/1995 Tateishi et al. ..... 428/548
5,478,671 A 12/1995 Idota ..... 429/194
5,536,591 A * 7/1996 Fetcenko et al. ..... 420/584.1
5,578,396 A 11/1996 Fauteux et al. ..... 429/209
5,643,690 A 7/1997 Tateishi et al. ..... 429/34
5,733,680 A 3/1998 Hong ..... 429/101
5,783,333 A * 7/1998 Mayer ..... 423/332
5,795,679 A 8/1998 Kawakami et al. ..... 429/218
5,962,160 A * 10/1999 Oyama et al. ..... 429/104
6,136,477 A * 10/2000 Gan et al. ..... 429/218.1
6,306,544 B1 * 10/2001 Frysz et al. ..... 429/233

* cited by examiner

COBALT-BASED ALLOYS AS POSITIVE ELECTRODE CURRENT COLLECTORS IN NONAQUEOUS ELECTROCHEMICAL CELLS

CROSS REFERENCE TO RELATED APPLICATION

The present application is a continuation-in-part application based on U.S. application Ser. No. 09/257,795, filed Feb. 25, 1999 now U.S. Pat. No. 6,,306,544.

BACKGROUND OF THE INVENTION

1. Field of the Invention

The present invention generally relates to a positive electrode current collector for an alkali metal, solid cathode, nonaqueous liquid electrolyte electrochemical cell, and more specifically to cobalt-based alloys as positive electrode current collector materials.

2. Prior Art

Solid cathode, liquid organic electrolyte, alkali metal anode electrochemical cells or batteries are used in applications ranging from power sources for implantable medical devices to down-hole instrumentation in oil/gas well drilling. Typically, the battery is comprised of a casing housing a positive electrode comprised of cathode active material, material to enhance conductivity, a binder material, and a current collector material; a negative electrode comprised of active material such as an alkali metal and a current collector material; a nonaqueous electrolyte solution which includes an alkali metal salt and an organic solvent system; and a separator material encapsulating either or both of the electrodes. Such a battery is described in greater detail in U.S. Pat. No. 4,830,940 to Keister et al., which is assigned to the assignee of the present invention and incorporated herein by reference.

The positive electrode current collector serves several functions. First, the positive electrode current collector acts as a support matrix for the cathode material utilized in the cell. Secondly, the positive electrode current collector serves to conduct the flow of electrons between the active material and the positive cell terminal. Consequently, the material selected as the positive electrode current collector affects the longevity and performance of the electrochemical cell into which it is fabricated. Accordingly, the positive electrode current collector material must maintain chemical stability and mechanical integrity in corrosive electrolytes throughout the anticipated useful life of the cell. In addition, as applications become more demanding on electrochemical cells containing nonaqueous electrolytes (including increased shelf life and extended long term performance), the availability of corrosion resistant materials that are suitable for these applications becomes more limited. For example, the availability of materials capable of operating or maintaining chemical stability at elevated temperatures is limited. Elevated temperatures may be encountered either during storage or under operating conditions (elevated temperature discharge down-hole in well drilling), or during autoclave sterilization of an implantable medical device powered by the electrochemical cell (Thiebolt III and Takeuchi, 1989, Progress in Batteries & Solar Cells 8:122–125).

The prior art has developed various corrosion resistant materials useful for positive electrode current collectors. However, certain materials corrode when exposed to elevated temperatures of about 72° C. or higher or when exposed to operating conditions in aggressive cell environments wherein surface passivity is compromised. Also, at elevated temperatures the chemical integrity of the positive electrode current collector material may depend on the cathode active material incorporated into the cathode. For example, if titanium is used as the current collector material and the cathode active material is fluorinated carbon, titanium can react with species present within the internal cell environment to undesirably increase cell impedance by fluorination and excessive passivation of the current collector interface (Fateev, S. A., Denisova, O. O., I. P. Monakhova et al., Zashchita Metallov, Vol. 24, No. 2, pp. 284–287, 1988, transl.). The kinetics of this process are temperature dependent. At elevated temperatures, excessive passivation may occur quite rapidly (for example, at 100° C., the reaction requires less than 10 days).

Other current collector alloys used to fabricate positive electrode current collectors have been described in the art. Highly alloyed chromium-containing stainless steel materials are described in Japanese patent publications Nos. 18647 and 15067. However, the ferritic stainless steel material disclosed in publication No. 15067 requires costly melting procedures, such as vacuum melting, to limit the alloy to the cited carbon and nitrogen levels. Highly alloyed nickel-containing ferritic stainless steel materials, which provide superior corrosion resistance, particularly where elevated temperature storage and performance is required, are disclosed in U.S. Pat. No. 5,114,810 to Frysz et al., which patent is assigned to the assignee of the present invention and incorporated herein by reference. However, use of such alloyed ferritic stainless steels is limited in several respects. Chief among them is the alloy is not readily available in thicknesses typically required for use as a current collector, and developing a commercial source has proven difficult. Current collectors are preferably thin to permit increased volumetric and gravimetric energy density, as well as to permit increased surface area per volume for rapid discharge at high current densities.

Therefore, the present invention is directed to providing a positive electrode current collector material which exhibits chemical compatibility with aggressive cell environments; provides high corrosion resistance but does not develop excessive passivation in the presence of fluorinated materials such as fluorinated carbon materials, and thereby maintains its inherent high interfacial conductivity; provides resistance to surface activation by material handling or mechanical means; and is manufacturable in the required form and thicknesses.

Cobalt-based alloys according to the present invention offer the characteristics required of such positive current collectors. This class of metals also offers other advantages, especially when used in cells for implantable medical devices. Typically, the power source of an implantable medical device contains current collectors made from wrought metal stock in sheet or foil form by convenient and economical chemical milling/photoetching processes. The present cobalt-based alloy current collectors are readily fabricated by these processes in contrast to the prior art high chromium ferritic alloys. The latter materials are generally formed by mechanical punching/expansion techniques which tend to leave sharp burrs on the current collector. It is costly to deburr such components and the burring condition limits collector configurations.

Even in the family of cobalt-based alloys, however, selection is limited. It is known to developers of cobalt-based alloys that certain elemental constituents, especially chromium, molybdenum and tungsten, are of vital importance in maximizing corrosion resistance. Thus, the total amount of chromium, molybdenum and/or tungsten present in a particular cobalt-based alloy is a primary determinant to the suitability of that alloy as a current collector. For example, HAVAR™, a cobalt-based alloy commercially available from Hamilton Precision Metals, Inc., Lancaster, Pa., has by weight percent, 42% cobalt, 19.5% chromium, 12.7% nickel, 2.7% tungsten, 2.2% molybdenum, 1.6% manganese, 0.2% carbon, with the balance being iron. HAVAR™ has a combined chromium, molybdenum and tungsten content of, by weight percent, about 24.4% and readily corrodes in certain cell environments in which ELGILOY®, typically containing a total of about 27% chromium and molybdenum, does not corrode. Consequently, there are only a handful of acceptable compositions among available metals and alloys which remain practically corrosion-free in certain demanding cell environments; high chromium ferritic stainless steels are one class and selected cobalt-based alloys are another.

SUMMARY OF THE INVENTION

It is, therefore, an object of the present invention to provide a material that is useful in fabricating positive electrode current collectors for solid cathode, liquid organic electrolyte, alkali metal electrochemical cells.

Another object of the present invention is to provide a positive electrode current collector material that is chemically compatible with aggressive electrochemical cell environments.

Another object of the present invention is to provide a positive electrode current collector material that exhibits high corrosion resistance and is resistant to excessive passivation and fluorination, i.e., is resistant to development of excessive interfacial electrical impedance.

Another object of the present invention is to provide a positive electrode current collector material that exhibits resistance to surface activation by material handing or mechanical means.

Another object of the present invention is to provide a positive electrode current collector material which is either commercially available in the required form or readily manufacturable to the required form.

Accordingly, the present invention relates to a novel alloyed material used to fabricate positive electrode current collectors for solid cathode, liquid organic electrolyte, alkali metal electrochemical cells. The present positive electrode current collector materials comprise cobalt-based alloys which provide high corrosion resistance, particularly where elevated temperature storage and/or discharge performance are required or when long term storage at a broad range of temperatures is needed, thereby increasing cell longevity relative to other positive electrode current collector materials. A preferred composition range for the cobalt-based alloys of the present invention comprises, by weight percent:

At least about 28% cobalt; nickel in an amount such that the sum of cobalt and nickel equals or exceeds about 35%; between about 19% and about 27.5% chromium; molybdenum and/or tungsten in an amount such that the sum of chromium, molybdenum and tungsten is at least about 25%, and more preferably at least about 27%; from 0% to about 32% iron; and from 0% to about 1% nitrogen. Nitrogen has been shown to be especially beneficial in preventing corrosion in cobalt-based alloys containing iron.

Furthermore, cobalt-based alloys according to the present invention may also comprise minor amounts of other elements such as silicon, phosphorous, sulfur, titanium, aluminum, tantalum, zirconium, lanthinum, boron, and manganese. As used herein, the term "minor" means an amount of an alloy constituent less than about 0.5%.

It is important to note that the use of the term "cobalt-based alloys" herein is not meant to imply that cobalt must be the largest constituent in all alloys meeting the compositional requirements of the present invention.

These and other aspects of the present invention will become more apparent to those skilled in the art by reference to the following description and to the appended drawings.

DETAILED DESCRIPTION OF THE INVENTION

Figure 1:
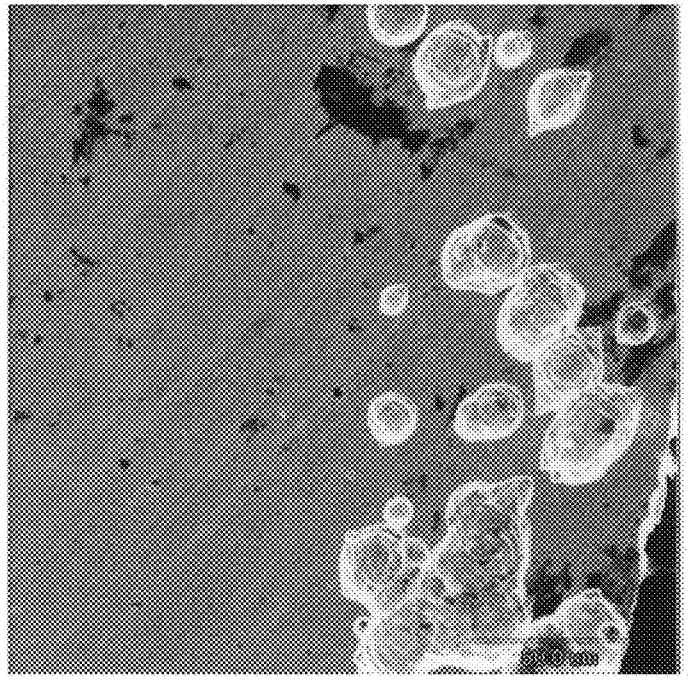
FIG. 1 is a scanning electron micrograph of a HAVAR™ screen removed from a $Li/CF_x$ cell discharged at 37° C. under a 1 kohm load.

The present invention provides a positive electrode current collector material for solid cathode, liquid organic electrolyte, alkali metal anode electrochemical cells. The current collector material comprises a cobalt-based alloy which provides superior corrosion and passivation resistance and resistance to fluorination at temperatures above about 72° C., to thereby increase cell longevity relative to other cathode current collector materials. Further, the cobalt-based alloy materials of the present invention are readily available in various forms suitable for fabricating current collectors therefrom. Preferred formulations for cobalt-based alloys according to the present invention are listed in Tables 1 to 4.

Table 1 lists the composition of one preferred cobalt-based alloy material for use as a positive electrode current collector according to the present invention. This material is commercially available in thicknesses down to about 0.005 inches under the trademark ELGILOY®, ASTM standard F1058-91, from Elgiloy Limited Partnership, Elgin, Ill. The compositional ranges of the various elements are by weight percent of the total material:

TABLE 1

| |
|---|
| From about 39% to about 41% cobalt;<br>about 19% to about 21% chromium;<br>about 15% to about 16% nickel;<br>about 6% to about 8% molybdenum;<br>about 1% to about 2% manganese;<br>and wherein the sum of carbon and beryllium is in an amount less than or equal to about 0.20%; and the remainder comprising iron. |

The cobalt-based alloy set forth in Table 1 may also comprise minor amounts of other elements selected from the group consisting of silicon, phosphorous, sulfur, titanium, and iron.

Table 2 lists the composition of another cobalt-based alloy material useful as a positive electrode current collector according to the present invention. The alloy is commercially available under the trademark MP35N® from SPS Technologies, Inc., Newton, Pa. The compositional ranges of the various elements are by weight percent of the total material:

TABLE 2

| |
|---|
| From about 28% to about 40% cobalt;<br>about 19% to about 21% chromium;<br>about 33% to about 37% nickel;<br>about 9% to about 11% molybdenum;<br>about 0.01% to about 1% iron; and<br>about 0.01% to about 1% titanium;<br>and wherein the sum of manganese, silicon, and carbon is in an amount less than or equal to about 0.5%. |

The cobalt-based alloy set forth in Table 2 may also comprise minor amounts of other elements selected from the group consisting of phosphorus and sulfur.

Table 3 lists the composition of another cobalt-based alloy material useful as a positive electrode current collector according to the present invention. The alloy is commercially available under the trademark ULTIMET® from Haynes International, Inc., Kokomo, Ind. The compositional ranges of the various elements are by weight percent of the total material:

TABLE 3

| |
|---|
| From about 51% to about 57% cobalt;<br>about 23.5% to about 27.5% chromium;<br>about 7% to about 11% nickel;<br>about 4% to about 6% molybdenum;<br>about 1% to about 5% iron;<br>about 1% to about 3% tungsten;<br>about 0.1% to about 1.5% manganese;<br>and wherein the sum of silicon and carbon is in an amount less than or equal to about 1.1%. In a preferred formulation of the ULTIMET ® alloy, cobalt comprises about 54%. |

The cobalt-based alloy set forth in Table 3 may also comprise minor amounts of other elements such as sulfur, phosphorous, and boron.

Table 4 lists the composition of another cobalt-based alloy material useful as a positive electrode current collector according to the present invention. The alloy is commercially available under the trademark L605™, series R30605 from Carpenter and under the trademark HAYNES® 25, ASTM standard F90–92 from Haynes International, Inc. The compositional ranges of the various elements are by weight percent of the total material:

TABLE 4

| |
|---|
| From about 45% to about 57% cobalt;<br>about 19% to about 21% chromium;<br>about 9% to about 11% nickel;<br>about 14% to about 16% tungsten;<br>about 0% to about 3% iron;<br>about 1% to about 2% manganese;<br>and wherein the sum of silicon and carbon is in an amount less than or equal to about 0.60%. |

The cobalt-based alloy set forth in Table 4 may also comprise minor amounts of other elements selected from the group consisting of phosphorous and sulfur.

Cobalt-based alloys of the present invention may be formed from conventional wrought metal stock in sheet or foil form by any applicable chemical or mechanical means. Current collectors can thus be made in the form of a metal sheet without holes, or in the form of screens produced by etching/chemical milling, by mechanical perforation with or without expansion after perforation, or by other means. As an alternative to wrought metal stock, sheet or foil stock made by powder metallurgy techniques can be the starting material, or complete current collectors can be produced in final form by powder metallurgy.

Most of the elemental constituents of cobalt-based alloy compositions of the present invention contribute directly to maintaining the critical property of corrosion resistance under the very demanding conditions described herein. The cobalt content of the positive electrode current collector material, supplemented by nickel, provides a "base" of corrosion resistance which is greatly augmented by the presence of critical amounts of chromium, molybdenum, and/or tungsten. The latter elements are known to have a very powerful effect on the protective ability of the passive layer that forms on these alloys.

Thus, the "base" may be comprised of, by weight percent, cobalt in the amount of at least about 28% with the total of cobalt and nickel being equal to at least about 35%. The remainder of the alloy formulation comprises, by weight percent, at least about 19% chromium, and amounts of molybdenum and/or tungsten such that the total of the chromium, molybdenum and/or tungsten is at least about 25%, and more preferably at least about 27%. At these levels of alloy enrichment, the goal of enhanced corrosion resistance in all its presently relevant forms is reached. The preferred amounts of chromium, molybdenum and/or tungsten confer on the alloys of the present invention a high degree of resistance to pitting and crevice corrosion in the presence of nonaqueous electrolytes activating cathode active materials typically coupled with alkali metal anode active materials, whether in a primary or a secondary electrochemical configuration, especially at elevated temperatures above about 72° C. Nitrogen and other elements present in minor amounts can also be beneficial to corrosion resistance.

Accordingly, the positive electrode current collector material of the present invention is useful in electrochemical cells having either a primary configuration with a positive electrode of both a solid cathode active material or a liquid catholyte/carbonaceous material supported on the cobalt-based current collector, or a secondary cell configuration. Regardless of the cell configuration, such cells preferably comprise an anode active material of a metal selected from Groups IA, IIA or IIIB of the Periodic Table of the Elements, including the alkali metals lithium, sodium, potassium, etc., and their alloys and intermetallic compounds including, for example, Li—Si, Li—Al, Li—B and Li—Si—B alloys and intermetallic compounds. The preferred anode active material comprises lithium, and the more preferred anode for a primary cell comprises a lithium alloy such as a lithium-aluminum alloy. However, the greater the amount of aluminum present by weight in the alloy, the lower the energy density of the cell.

In a primary cell, the form of the anode may vary, but preferably the anode is a thin metal sheet or foil of the anode metal, pressed or rolled on a metallic anode current collector, i.e., preferably comprising nickel, to form an anode component. The anode component has an extended tab or lead of the same material as the anode current collector, i.e., preferably nickel, integrally formed therewith such as by welding and contacted by a weld to a cell case of conductive metal in a case-negative electrical configuration. Alternatively, the anode may be formed in some other geometry, such as a bobbin shape, cylinder or pellet to allow an alternate low surface area cell design.

The positive electrode or cathode of the present electrochemical cell is preferably of carbonaceous materials such as graphite, carbon and fluorinated carbon. Such carbonaceous materials are useful in both liquid catholyte and solid cathode primary cells and in rechargeable, secondary cells. The positive electrode more preferably comprises a fluorinated carbon represented by the formula $(CF_x)_n$ wherein x varies between about 0.1 to 1.9 and preferably between about 0.5 and 1.2 and $(C_2F)_n$ wherein the n refers to the number of monomer units which can vary widely. These electrode active materials are composed of carbon and fluorine, and include graphitic and nongraphitic forms of carbon, such as coke, charcoal or activated carbon.

Other cathode active materials useful for constructing an electrochemical cell according to the present invention are selected from a metal, a metal oxide, a metal sulfide or a mixed metal oxide. Such electrode active materials include silver vanadium oxide, copper silver vanadium oxide, manganese dioxide, titanium disulfide, copper oxide, copper sulfide, iron sulfide, iron disulfide, cobalt oxide, nickel oxide, copper vanadium oxide, and other materials typically used in alkali metal electrochemical cells. In secondary cells, the positive electrode preferably comprises a lithiated material that is stable in air and readily handled. Examples of such air-stable lithiated cathode materials include oxides, sulfides, selenides, and tellurides of such metals as vanadium, titanium, chromium, copper, molybdenum, niobium, iron, nickel, cobalt and manganese. The more preferred oxides include $LiNiO_2$, $LiMn_2O_4$, $LiCoO_2$, $LiCo_{0.92}Sn_{0.08}O_2$ and $LiCo_{1-x}Ni_xO_2$.

To discharge such secondary cells, the lithium metal comprising the positive electrode is intercalated into a carbonaceous negative electrode or anode by applying an externally generated electrical potential to recharge the cell. The applied recharging electrical potential serves to draw the alkali metal from the cathode material, through the electrolyte and into the carbonaceous anode to saturate the carbon comprising the anode. The cell is then provided with an electrical potential and is discharged in a normal manner.

An alternate secondary cell construction comprises intercalating the carbonaceous material with the active alkali material before the negative electrode is incorporated into the cell. In this case, the positive electrode body can be solid and comprise, but not be limited to, such materials as manganese dioxide, silver vanadium oxide, titanium disulfide, copper oxide, copper sulfide, iron sulfide, iron disulfide and fluorinated carbon. However, this approach is compromised by problems associated with handling lithiated carbon outside of the cell. Lithiated carbon tends to react when contacted by air or water.

The positive electrode for a primary or a secondary cell is prepared by mixing about 80 to about 99 weight percent of an already prepared electrode active material in a finely divided form with up to about 10 weight percent of a binder material, preferably a thermoplastic polymeric binder material. The term thermoplastic polymeric binder material is used in its broad sense and any polymeric material, preferably in a powdered form, which is inert in the cell and which passes through a thermoplastic state, whether or not it finally sets or cures, is included within the meaning "thermoplastic polymer". Representative materials include polyethylene, polypropylene and fluoropolymers such as fluorinated ethylene and propylene, polyvinylidene fluoride (PVDF), polyethylenetetrafluoroethylene (ETFE), and polytetrafluoroethylene (PTFE), the latter material being most preferred. Natural rubbers are also useful as the binder material with the present invention.

In the case of a primary, solid cathode electrochemical cell, the cathode active material is further combined with up to about 5 weight percent of a discharge promoter diluent such as acetylene black, carbon black and/or graphite. A preferred carbonaceous diluent is Shawinigan® acetylene black carbon. Metallic powders such as nickel, aluminum, titanium and stainless steel in powder form are also useful as conductive diluents.

Similarly, if the active material is a carbonaceous counterelectrode in a secondary cell, the electrode material preferably includes a conductive diluent and a binder material in a similar manner as the previously described primary, solid cathode electrochemical cell.

The thusly prepared cathode active admixture may be formed into a free-standing sheet prior to being contacted to a conductive positive current collector of a cobalt-based alloy according to the present invention to form the positive electrode. The manner in which the cathode active admixture is prepared into a free-standing sheet is thoroughly described in U.S. Pat. No. 5,435,874 to Takeuchi et al., which is assigned to the assignee of the present and incorporated herein by reference. Further, cathode components for incorporation into a cell may also be prepared by rolling, spreading or pressing the cathode active admixture onto the cobalt-based alloy current collector of the present invention. Cathodes prepared as described above are flexible and may be in the form of one or more plates operatively associated with at least one or more plates of anode material, or in the form of a strip wound with a corresponding strip of anode material in a structure similar to a "jellyroll".

Whether the cell is constructed as a primary or secondary electrochemical system, the cell of the present invention includes a separator to provide physical segregation between the anode and cathode electrodes. The separator is of electrically insulative material, and the separator material also is chemically unreactive with and insoluble in the electrolyte. In addition, the separator material has a degree of porosity sufficient to allow flow therethrough of the electrolyte during the electrochemical reaction of the cell. Illustrative separator materials include fabrics woven from fluoropolymeric fibers of polyethylenetetrafluoroethylene and polyethylenechlorotrifluoroethylene used either alone or laminated with a fluoropolymeric microporous film. Other suitable separator materials include non-woven glass, polypropylene, polyethylene, glass fiber materials, ceramics, a polytetrafluoroethylene membrane commercially available under the designation ZITEX (Chemplast Inc.), a polypropylene membrane commercially available under the designation CELGARD (Celanese Plastic Company, Inc.) and a membrane commercially available under the designation DEXIGLAS (C. H. Dexter, Div., Dexter Corp.).

The electrochemical cell of the present invention further includes a nonaqueous, tonically conductive electrolyte which serves as a medium for migration of ions between the anode and the cathode electrodes during the electrochemical reactions of the cell. Thus, nonaqueous electrolytes suitable for the present invention are substantially inert to the anode and cathode materials, and they exhibit those physical properties necessary for ionic transport, namely, low viscosity, low surface tension and wettability.

Suitable nonaqueous electrolyte solutions that are useful for activating both primary and secondary cells having an electrode couple of alkali metal or an alkali metal-containing material, and a solid active material counterelectrode preferably comprise a combination of a lithium salt and an organic solvent system. More preferably, the electrolyte includes an ionizable alkali metal salt dissolved in an aprotic organic solvent or a mixture of solvents comprising a low viscosity solvent and a high permittivity solvent. The inorganic, ionically conductive salt serves as the vehicle for migration of the alkali metal ions to intercalate into the counterelectrode. Preferably, the ion-forming alkali metal salt is similar to the alkali metal comprising the anode active material. Suitable salts include $LiPF_6$, $LiBF_4$, $LiAsF_6$, $LiSbF_6$, $LiClO_4$, $LiAlCl_4$, $LiGaCl_4$, $LiC(SO_2CF_3)_3$, $LiO_2$, $LiN(SO_2CF_3)_2$, LiSCN, $LiO_3SCF_2CF_3$, $LiC_6F_5SO_3$, $LiO_2CCF_3$, $LiSO_3F$, $LiB(C_6H_5)_4$, $LiCF_3SO_3$, and mixtures thereof. Suitable salt concentrations typically range between about 0.8 to 1.5 molar.

In electrochemical systems having a solid cathode or in secondary cells, the nonaqueous solvent system comprises low viscosity solvents including tetrahydrofuran (THF), methyl acetate (MA), diglyme, trigylme, tetragylme, dimethyl carbonate (DMC), ethylmethyl carbonate (EMC), 1,2-dimethoxyethane (DME), diisopropylether, 1,2-diethoxyethane, 1-ethoxy,2-methoxyethane, dipropyl carbonate, ethylmethyl carbonate, methylpropyl carbonate, ethylpropyl carbonate, diethyl carbonate, and mixtures thereof. While not necessary, the electrolyte also preferably includes a high permittivity solvent selected from cyclic carbonates, cyclic esters and cyclic amides such as propylene carbonate (PC), ethylene carbonate (EC), butylene carbonate, acetonitrile, dimethyl sulfoxide, dimethyl formamide, dimethyl acetamide, γ-butyrolactone (GBL), γ-valerolactone, N-methyl-pyrrolidinone (NMP), and mixtures thereof. For a solid cathode primary or secondary cell having lithium as the anode active material, the preferred electrolyte is $LiAsF_6$ in a 50:50, by volume, mixture of PC/DME. For a $Li/CF_x$ cell, the preferred electrolyte is 1.0M to 1.4M $LiBF_4$ in γ-butyrolactone (GBL).

The preferred form of a primary alkali metal/solid cathode electrochemical cell is a case-negative design wherein the anode is in contact with a conductive metal casing and the cathode contacted to the cobalt-based current collector is the positive terminal. In a secondary electrochemical cell having a case-negative configuration, the anode (counterelectrode)/cathode couple is inserted into the conductive metal casing such that the casing is connected to the carbonaceous counterelectrode current collector, and the lithiated material is contacted to a second current collector. In either case, the current collector for the lithiated material or the cathode electrode is in contact with the positive terminal pin via a lead of the same material as the current collector. The lead is welded to both the current collector and the positive terminal pin for electrical contact.

A preferred material for the casing is titanium although stainless steel, mild steel, nickel-plated mild steel and aluminum are also suitable. The casing header comprises a metallic lid having an opening to accommodate the glass-to-metal seal/terminal pin feedthrough for the cathode electrode. The anode electrode or counterelectrode is preferably connected to the case or the lid. An additional opening is provided for electrolyte filling. The casing header comprises elements having compatibility with the other components of the electrochemical cell and is resistant to corrosion. The cell is thereafter filled with the electrolyte solution described hereinabove and hermetically sealed such as by close-welding a titanium plug over the fill hole, but not limited thereto. The cell of the present invention can also be constructed in a case-positive design.

The electrochemical cell of the present invention comprising the cobalt-based alloy as the positive electrode current collector operates in the following manner. When the ionically conductive electrolytic solution becomes operatively associated with the anode and the cathode of the cell, an electrical potential difference is developed between terminals operatively connected to the anode and the cathode. The electrochemical reaction at the anode includes oxidation to form metal ions during discharge of the cell. The electrochemical reaction at the cathode involves intercalation or insertion of ions which migrate from the anode to the cathode and conversion of those ions into atomic or molecular forms.

The electrochemical cell according to the present invention is illustrated further by the following examples, which are given to enable those skilled in the art to more clearly understand and practice the present invention. The examples should not be considered as a limitation of the scope of the invention, but are described as being illustrative and representative thereof.

EXAMPLE I

The corrosion resistant properties of the cobalt-based alloys of the present invention were evaluated by single plate, 8.6 mm prismatic $Li/CF_x$ cells, utilizing, by weight percent, 91% active carbon monofluoride and 1M $LiBF_4$ in γ-butyrolactone as electrolyte. The cobalt-based positive electrode current collectors were used in the form of etched, 5 mil thick screens. Etched nickel screens served as the anodic current collectors. Following assembly, the cells were predischarged for 2 or 16 hours at 37° C. under a 499 ohm load. Following a 28 day period of open circuit storage at 37° C., some of the cells were heat treated by exposing them to 130° C. for 1 hour. The cells were allowed to cool to room temperature prior to beginning the next exposure. This cycling was repeated until the autoclaved cells were exposed to 130° C. for a total of 5 hours. The cells were then placed either on open circuit storage at 37° C. and subsequently discharged at 37° C. under a 1 kΩ load or were discharged at 37° C. under a 1 kΩ load without storage.

Figure 2:
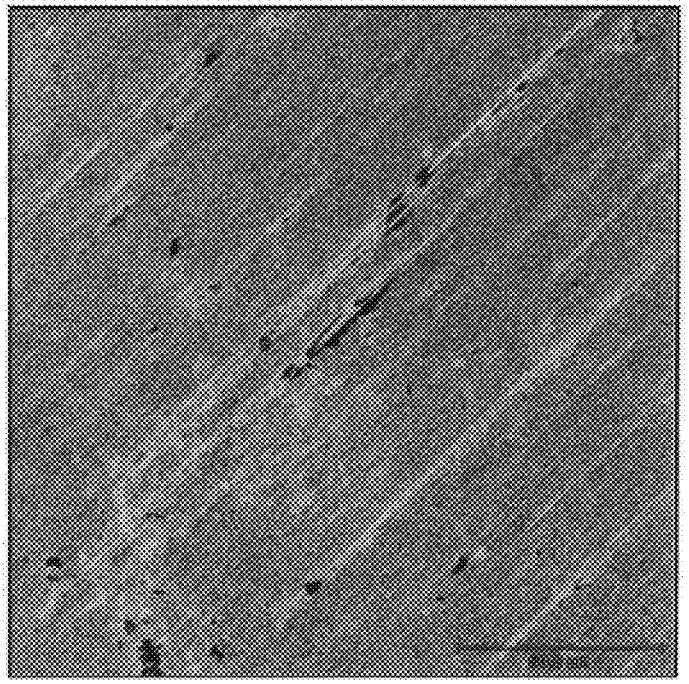
FIG. 2 is a scanning electron micrograph of a present invention ELGILOY® screen removed from a $Li/CF_x$ cell discharged at 37° C. under a 1 kohm load.

The cells were built using cathodic current collectors fabricated from either ELGILOY® or HAVAR™. After reaching end-of-life under 1 kohm loads, the cells were destructively analyzed so that the corrosion resistance of the internal components could be assessed. Upon analysis, it was found that some of the HAVAR™ screens had exhibited pitting corrosion. It is believed the primary reason for the pitting corrosion observed in the HAVAR™ screens was due to the relatively low total level of chromium, molybdenum and tungsten, i.e., about 24.4 weight percent, in this alloy. ELGILOY® typically contains about 27% total chromium, molybdenum and tungsten, by weight percent, and did not exhibit pitting corrosion. FIG. 1 illustrates the typical pitting corrosion of the HAVAR™ screens. None of the ELGILOY® screens, however, exhibited corrosion, as shown in FIG. 2. Both screens were photographed with an electron microscope at 600×.

Figure 3:
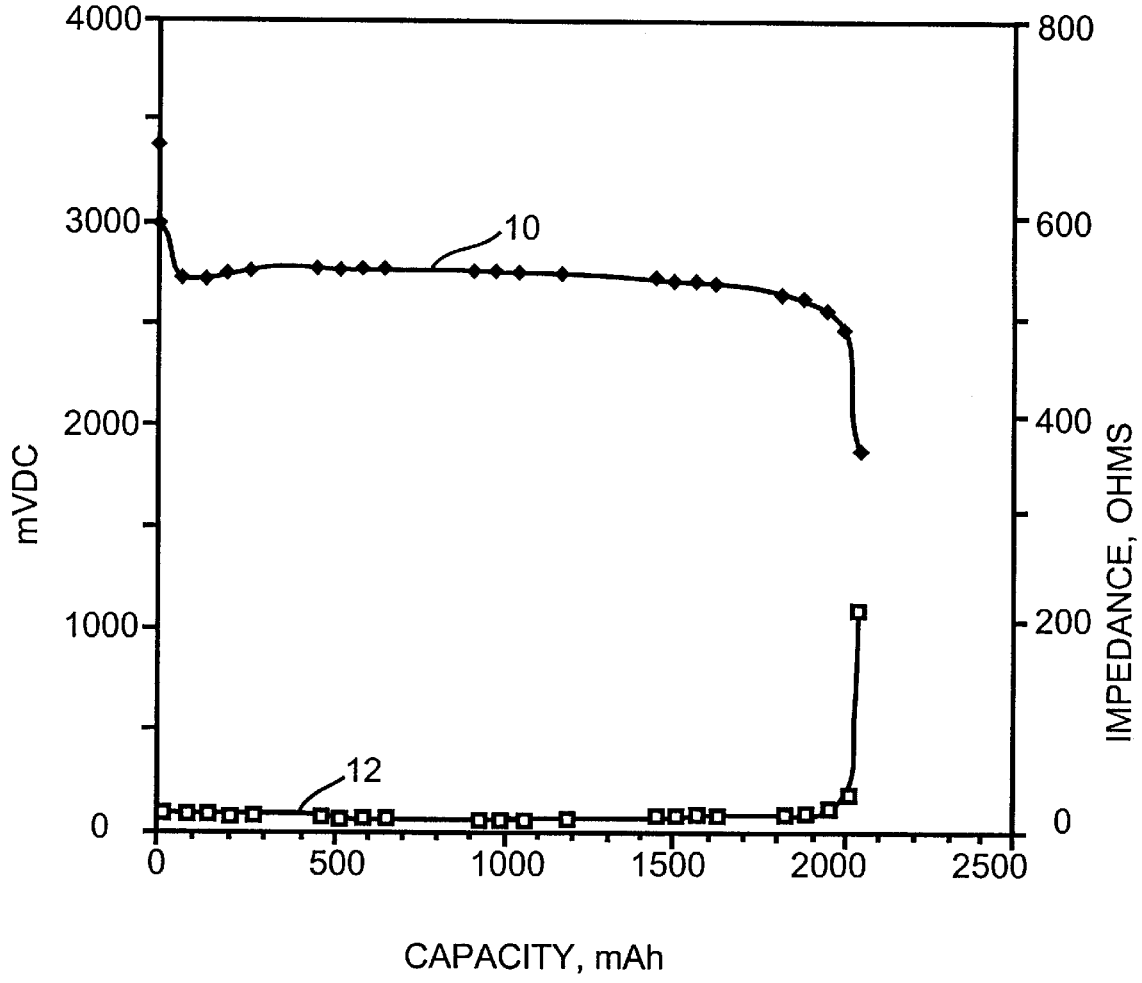
FIG. 3 is an average discharge profile for heat treated $Li/CF_x$ cells containing ELGILOY® screens discharged at 37° C. under 1 kohm loads following 7.5 months open circuit storage at 37° C.
Figure 4:
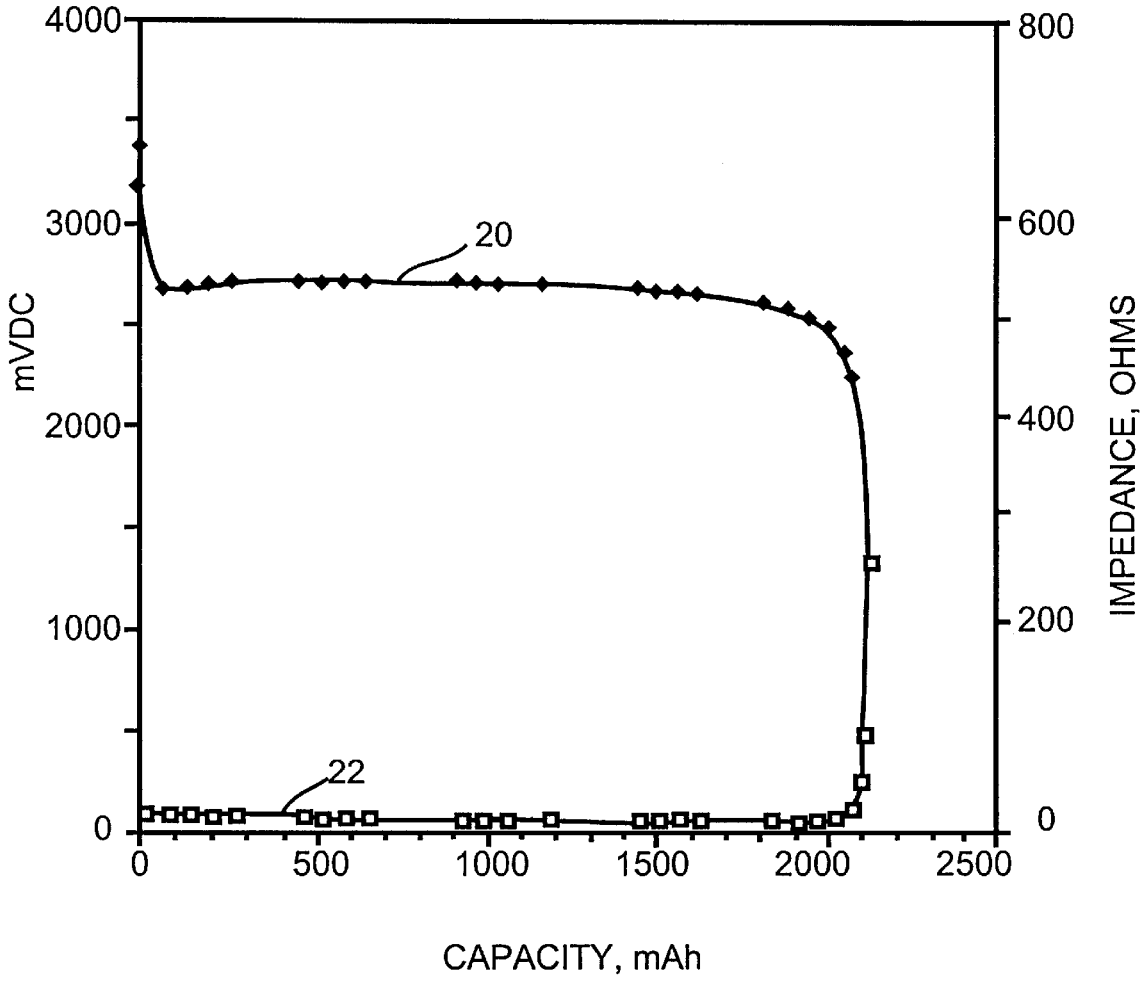
FIG. 4 is an average discharge profile for non-heat treated $Li/CF_x$ cells containing ELGILOY® screens discharged at 37° C. under 1 kohm loads following 7.5 months open circuit storage at 37° C.
Figure 5:
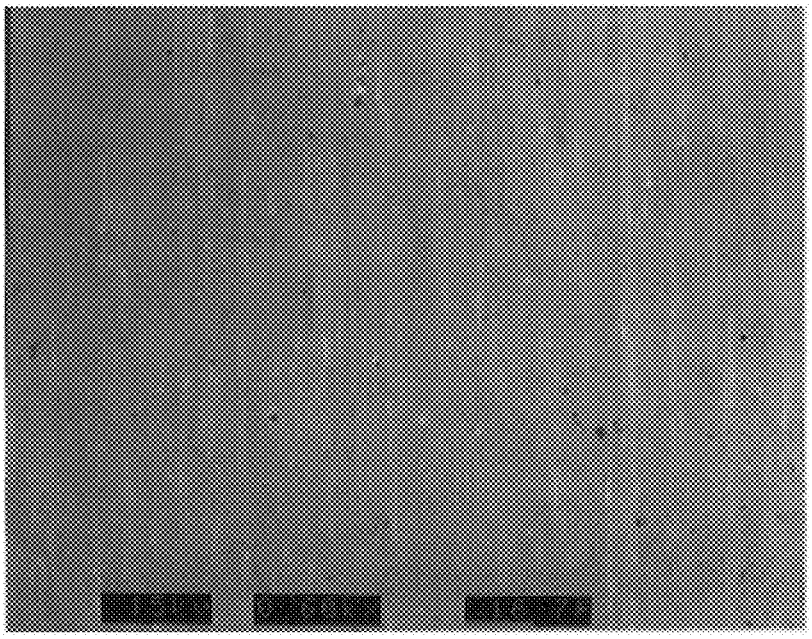
FIG. 5 is a scanning electron micrograph of an ELGILOY® screen removed from a $Li/CF_x$ cell discharged at 37° C. under a 1 kohm load following 7.5 months open circuit storage at 37° C.

Following open circuit storage for 7.5 months at 37° C. and subsequent discharge at 37° C. under 1 kohm loads, cells fabricated with ELGILOY® screens as the positive current collectors were found to maintain high running potentials and low internal impedance for both the heat treated cells (FIG. 3) and the non-heated cells (FIG. 4). Specifically, curve 10 in FIG. 3 was constructed from the discharge capacity of a representative heat treated cell and curve 12 shows the impedance rise as a function of the discharge of that cell. In contrast, curve 20 in FIG. 4 was constructed from the discharge of a representative one of the untreated cells and curve 22 was constructed from the impedance measurement recorded during cell discharge. This test indicated that there was no degradation in the ELGILOY® screen condition due to exposure of the material to the aggressive cell environment. Destructive analysis results confirmed the absence of screen corrosion in cells which have been autoclaved as well as in cells which had not been heat treated. FIG. 5 is an electron microscope photograph of an ELGILOY® screen after open circuit storage for 7.5 months at 37° C. followed by discharge under a 1 kΩ load at 37° C. for 7.5 months, wherein the cell was not heat treated.

Figure 6:
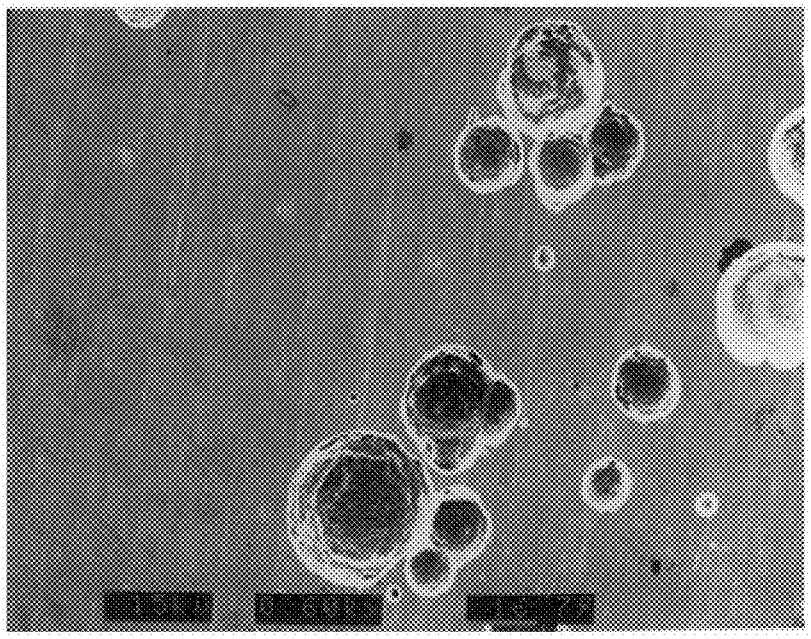
FIG. 6 is a scanning electron micrograph of a prior art HAVAR™ screen removed from a $Li/CF_x$ cell discharged at 37° C. under a 1 kohm load following 7.5 months open circuit storage at 37° C.

In contrast, cells fabricated with a HAVAR™ screen, which were stored on open circuit for 10 months at 37° C. and subsequently discharged at 37° C. under a 1 kΩ load, exhibited localized pitting corrosion, as shown in FIG. 6 for a representative one of them.

EXAMPLE II

In this example, different positive electrode current collector materials were compared for susceptibility to chemical interactions and excessive passivation/fluorination with a liquid organic electrolyte. Test cells were constructed having a lithium anode, carbon monofluoride as the cathode active material, and an electrolyte solution comprising $LiBF_4$ dissolved in γ-butyrolactone as the organic solvent. The cathode was fabricated by pressing a sintered mixture of, by weight percent, 91% active cathode material, 4% binder, and 5% carbon black to the positive electrode current collector. Three groups of cells, sorted according to the material used for the positive electrode current collector, were subjected to open circuit storage at elevated temperature (72° C.). In each cell group, the positive electrode current collector was in the form of a metal screen. Internal impedance, measured at a frequency of 1,000 Hz, was used as an indicator of the level of passivation/fluorination thereby affecting the performance of the electrochemical cell. A comparison of the cells containing the various positive electrode current collectors is shown in Table 5.

TABLE 5

| Material of Positive Electrode Current Collector | Predischarge Regime | Open Circuit Voltage at day 223 at 72° C. | 1 kHz Internal Impedance at day 223 at 72° C. |
|---|---|---|---|
| Chromium ferritic | 16 hrs | 3,412 ± 5 mV | 12 ± 1 Ω |
| Chromium ferritic | 2 hrs | 3,405 ± 36 mV | 33 ± 22 Ω |
| ELGILOY ® | 2 hrs | 3,425 mV | 17 Ω |
| Titanium | 16 hrs | 2,855 ± 11 mV | 142 ± 20 Ω |
| Titanium | 2 hrs | 3,346 ± 3 mV | 264 ± 24 Ω |

Cells containing chromium ferritic screens as the alloy in the positive electrode current collector, and cells containing a cobalt-based alloy of the present invention as the positive electrode current collector exhibited low internal impedance indicating resistance to passivation/fluorination. In comparative terms, cells containing titanium screens as the positive electrode current collector had high internal impedance, indicative of the occurrence of passivation/fluorination.

EXAMPLE III

HAVAR™, ELGILOY®, MP35N®, ULTIMET®, HAYNES® 25 and L-605™ discs were subjected to cyclic polarization testing at room temperature as a qualitative technique to determine the material behavior in an electrolytic solution. The various discs were scanned at a rate of 0.5 mV/s from 2 V to 5 V in an electrolytic solution comprising $LiBF_4$ dissolved in γ-butyrolactone as the organic solvent, with a lithium reference electrode and a platinum wire counter electrode. Exposure time was about 5 hours. The method used to conduct these tests conformed to the American Society for Testing and Materials (ASTM) method G5-82 entitled "Standard Reference Test Method for Making Potentiostatic and Potentiodynamic Anodic Polarization Measurements."

Figure 7A:
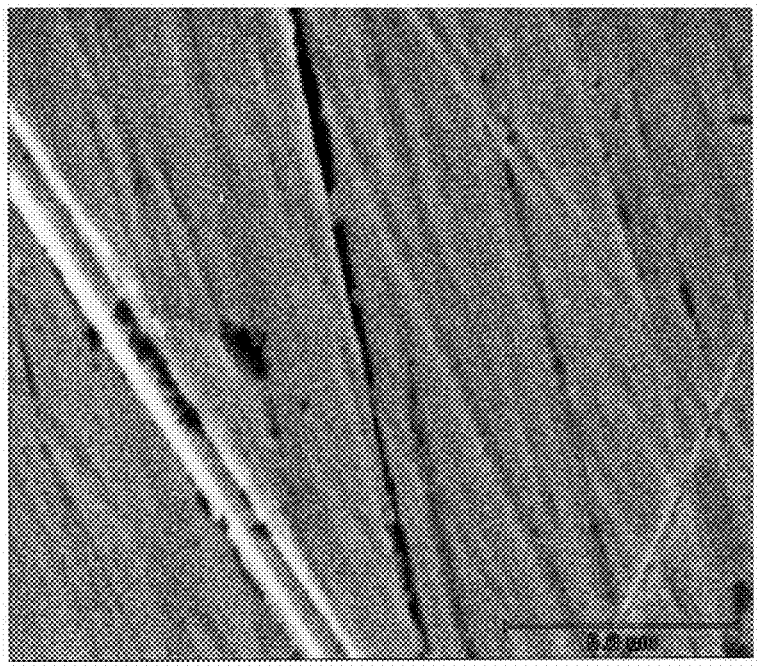
FIGS. 7A, 8A, 9A, 10A, 11A and 12A are scanning electron micrographs of HAVAR™, ELGILOY®, MP35N®, ULTIMET®, HAYNES® 25 and L-605™ alloy discs, respectively, unexposed to an electrolyte of $LiBF_4$ dissolved in γ-butyrolactone, respectively, and respective
Figure 7B:
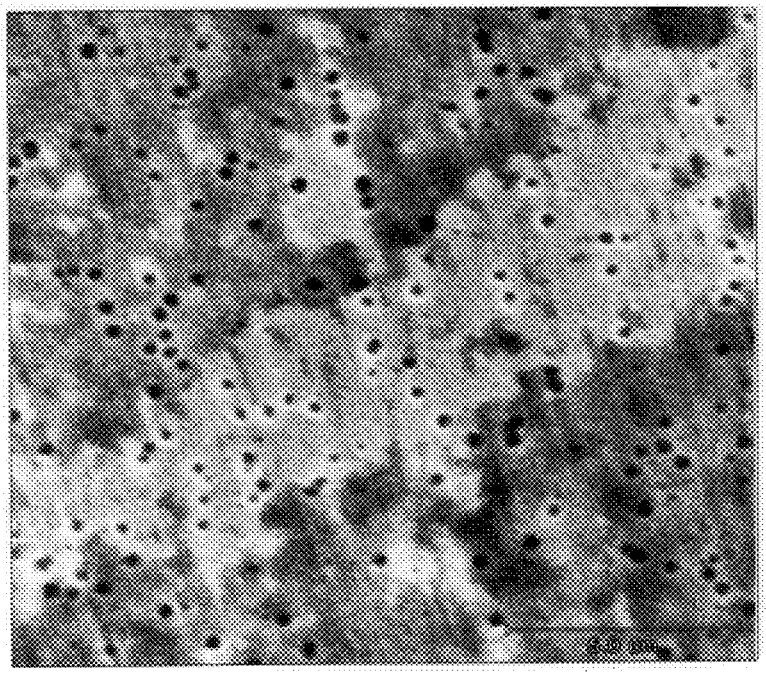
FIGS. 7B, 8B, 9B, 10B, 11B and 12B are scanning electron micrographs of those alloys after exposure to the electrolyte.
Figure 8A:
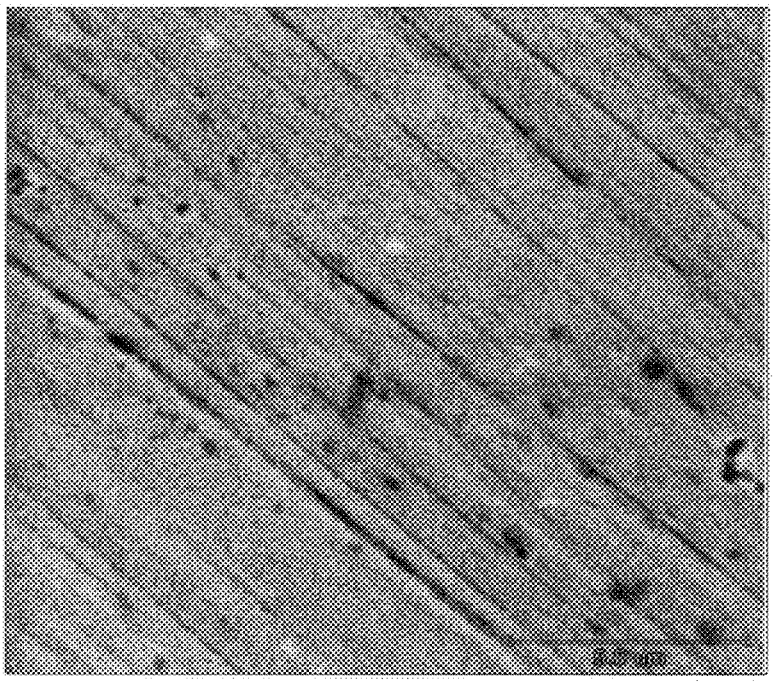
Figure 8B:
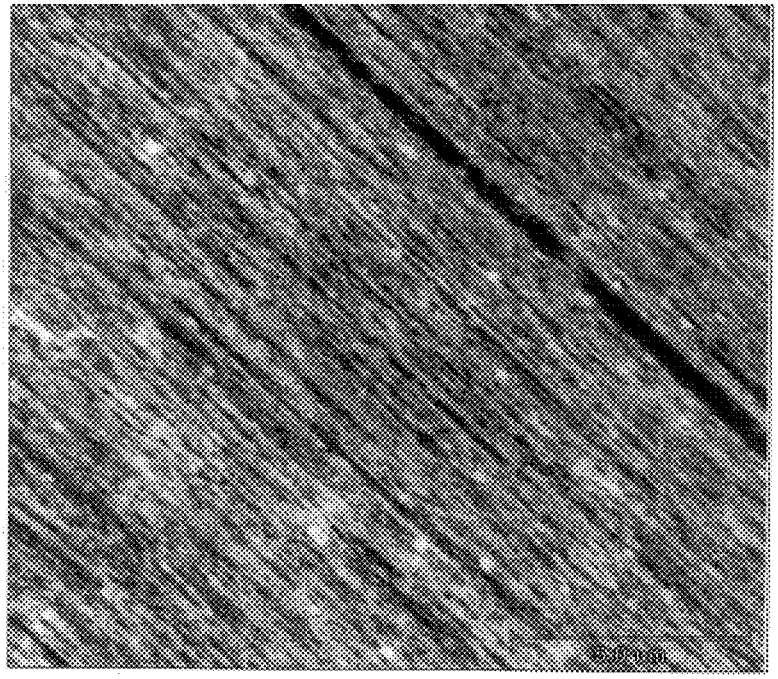
Figure 9A:
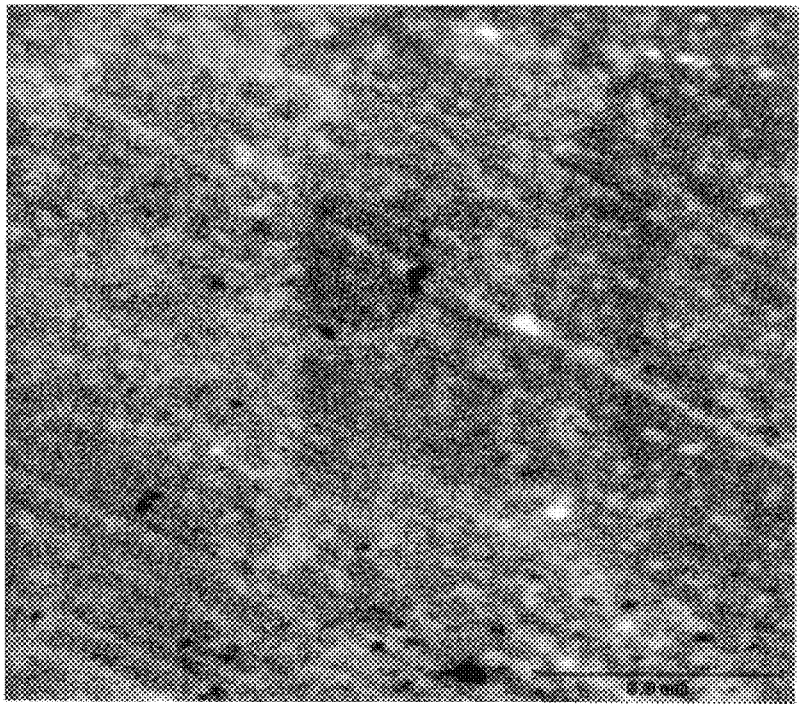
Figure 9B:
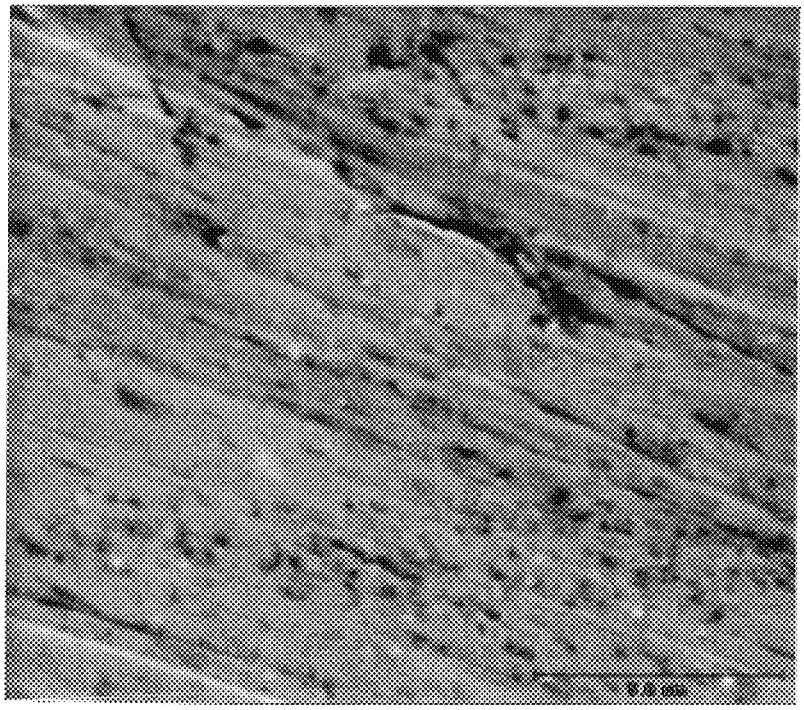
Figure 10A:
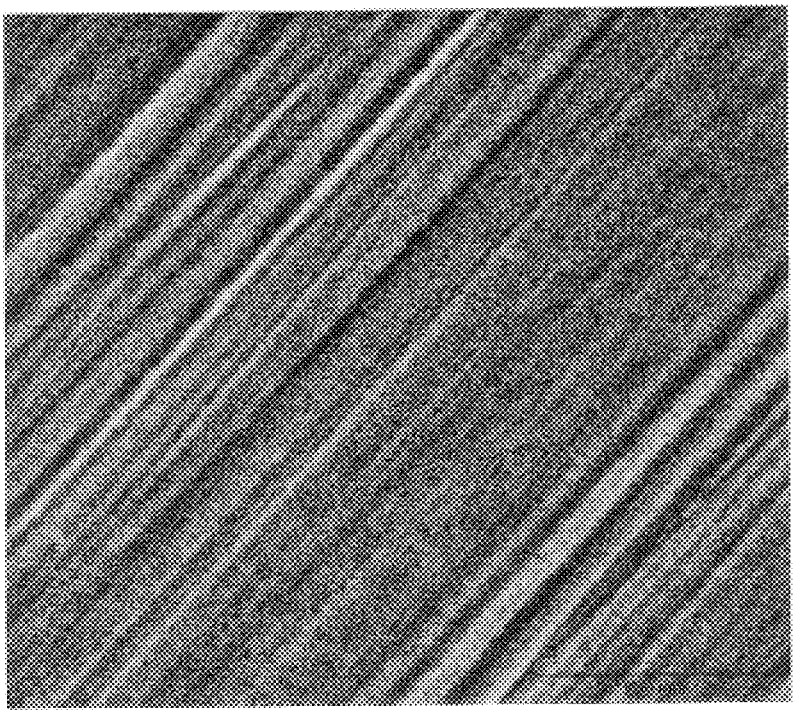
Figure 10B:
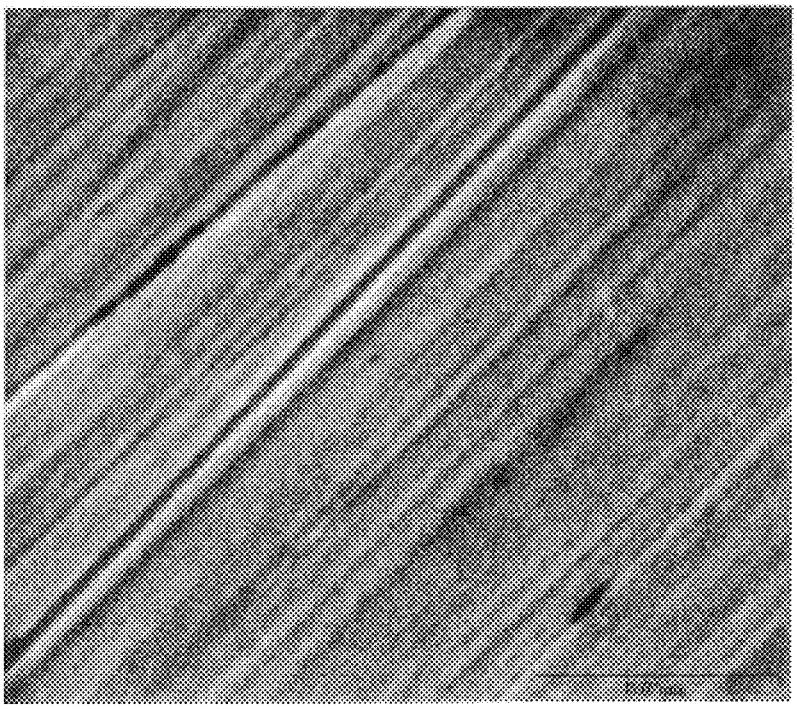
Figure 11A:
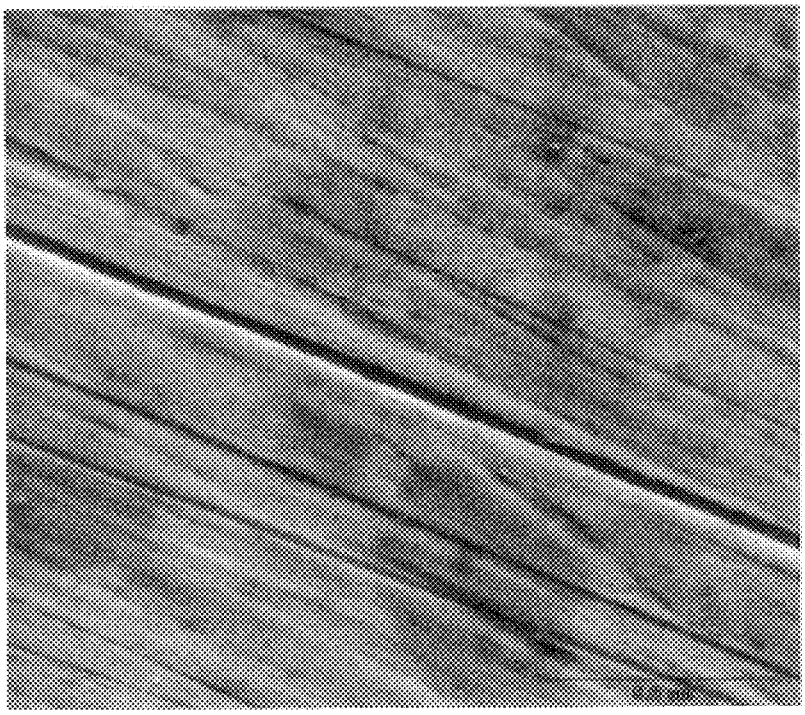
Figure 11B:
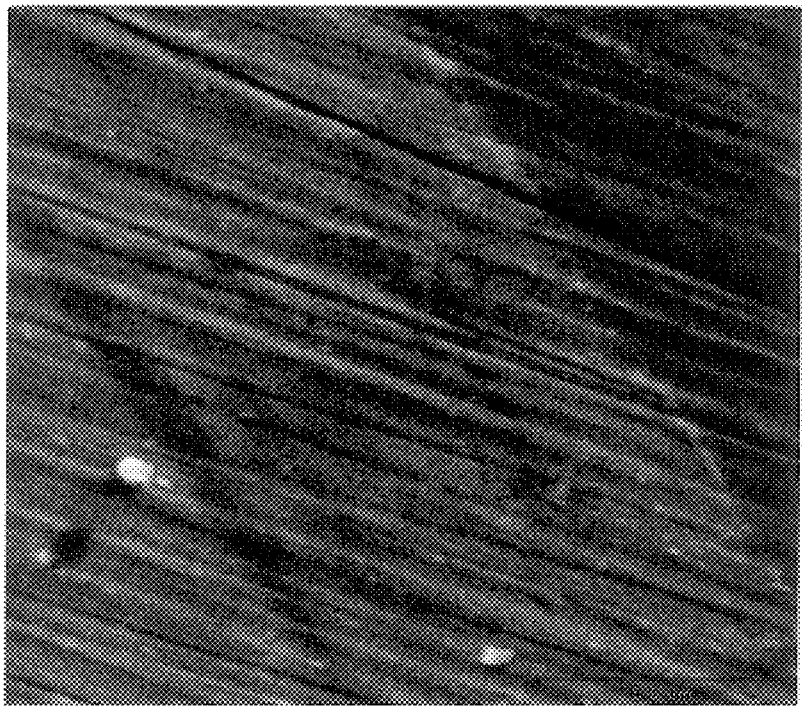
Figure 12A:
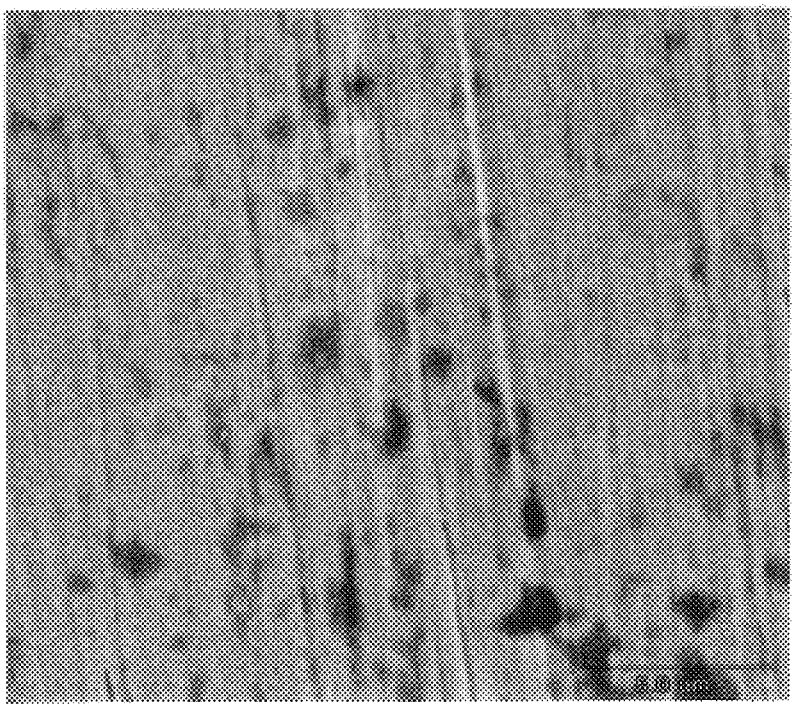
Figure 12B:
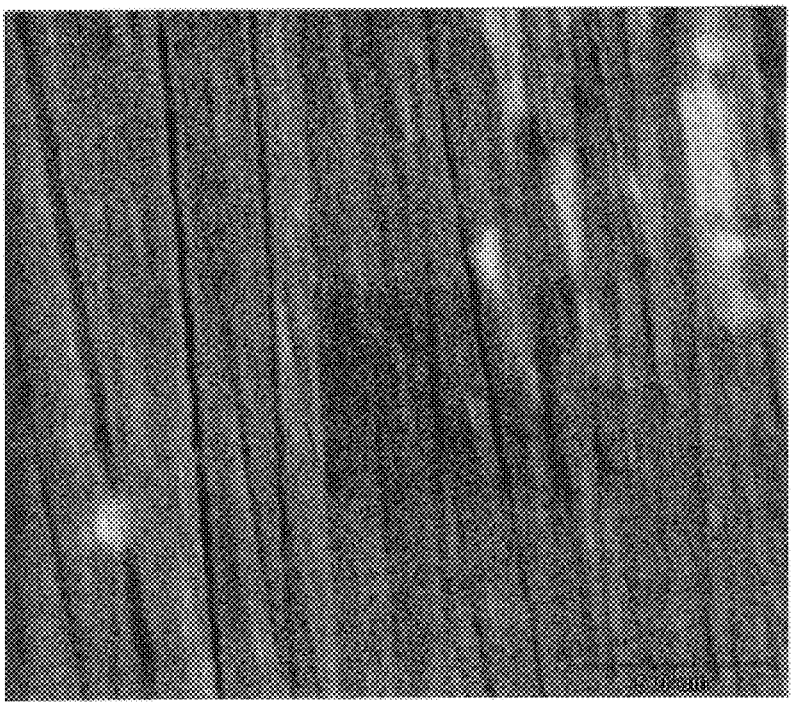

HAVAR™ was found to be the only metal alloy to exhibit pitting corrosion after being exposed to electrolyte during cyclic polarization testing. Scanning electron micrographs of the various cobalt alloy discs at 5,000× showing areas exposed to and not exposed to the electrolyte are presented in FIGS. 7A to 12B. Particularly, FIGS. 7A and 7B are scanning electron micrographs of a prior art HAVAR™ alloy disc. FIGS. 8A and 8B are scanning electron micrographs of an ELGILOY® disc. FIGS. 9A and 9B are scanning electron micrographs of a MP35N® disc. FIGS. 10A and 10B are scanning electron micrographs of an ULTIMET® disc. FIGS. 11A and 11B are scanning electron micrographs of a HAYNES® 25 disc. And, FIGS. 12A and 12B are scanning electron micrographs of an L-605™ Carpenter disc.

In present day electrical energy storage devices such as electrolytic capacitors, ceramic capacitors, foil capacitors, super capacitors, double layer capacitors, and batteries including aqueous and nonaqueous primary and secondary batteries, the trend is for smaller devices having increased energy density. Accordingly, the current collector for the cathode electrode must be compatible with aggressive electrochemical cell environments; resistant to excessive fluorination and passivation at elevated temperatures and/or over extended periods of times; resistant to surface activation by material handling or mechanical means; and being generally inert, when alloyed tend to be less susceptible to chemical interactions with the liquid organic electrolyte and/or the cathode active materials than prior art current collector materials. Such chemical interactions may include oxidation, passivation/fluorination, precipitation, and surface activation, all affecting the longevity and performance of the electrochemical cell. Excessive passivation/fluorination, in particular, can affect the electrochemical cell performance by causing relatively high levels of internal impedance. The cobalt-based alloys of the present invention meet these demanding standards. On the other hand, HAVAR™ alloys are outside of the present invention. The pitting observed in the above examples is an insidious drawback to the use of that material in corrosive cell environments. Given the relatively thin nature of present current collectors, dictated by the desire for smaller and more powerful energy devices, pitting is a problem that could eventually lead to breeching of the current collector, and eventual premature end of the energy device's useful life.

It is appreciated that various modifications to the inventive concepts described herein may be apparent to those skilled in the art without departing from the spirit and scope of the present invention as defined by the hereinafter appended claims.

What is claimed is:

1. A current collector for use in an electrical energy storage device, the current collector of an alloy comprising, by weight percent:

a) about 51% to about 57% cobalt;

b) about 23.5% to about 27.5% chromium;

c) about 7% to about 11% nickel;

d) about 4% to about 6% molybdenum;

e) about 1% to about 5% iron;

f) about 1% to about 3% tungsten;

g) about 0.1% to about 1.5% manganese; and wherein the sum of silicon and carbon is in an amount less than or equal to about 1.1%.

2. The current collector of claim 1 wherein the alloy further comprises minor amounts of at least one element selected from the group consisting of silicon, phosphorus, sulfur, titanium, aluminum, tantalum, zirconium, lanthium, boron, beryllium, manganese, and mixtures thereof.

3. The current collector of claim 1 wherein cobalt comprises about 54% of the alloy.

4. A current collector for use in an electrical energy storage device, the current collector of an alloy comprising, by weight percent:

a) about 45% to about 57% cobalt;

b) about 19% to about 21% chromium;

c) about 9% to about 11% nickel;

d) about 14% to about 16% tungsten;

e) about 0% to about 3% iron;

f) about 1% to about 2% manganese; and wherein the sum of silicon and carbon is in an amount less than or equal to about 0.60%.

5. The current collector of claim 4 wherein the alloy comprises minor amounts of either phosphorous or sulfur, and mixtures thereof.

6. An electrochemical cell, which comprises:

a) an anode;

b) a counter electrode comprising at least one electrode active material supported on a current collector, wherein, by weight percent, the current collector is of an alloy comprising:

i) about 51% to about 57% cobalt;

ii) about 23.5% to about 27.5% chromium;

iii) about 7% to about 11% nickel;

iv) about 4% to about 6% molybdenum;

v) about 1% to about 5% iron;

vii) about 1% to about 3% tungsten; and vii) about 0.1% to about 1.5% manganese; and wherein the sum of silicon and carbon is in an amount less than or equal to about 1.1%; and c) an electrolyte activating the anode and the counter electrode.

7. The electrochemical cell of claim 6 wherein the anode is lithium and the electrode active material of the counter electrode is fluorinated carbon.

8. A method for providing any electrochemical cell, comprising the steps of:

a) providing an anode;

b) providing a counter electrode comprising at least one electrode active material supported on a current collector, wherein, by weight percent, the current collector is an alloy comprising:

i) at least about 28% cobalt;

ii) nickel in a first concentration of from about 7% to about 11% or in a second concentration from about 33% to about 47%, wherein when the nickel is in the second concentration, there is also about 0.01% to about 1% titanium;

iii) about 19% to 27.5% chromium;

iv) at least one of molybdenum and tungsten in an amount such that the sum of chromium, molybdenum and tungsten is at least about 25%;

v) 0 to about 0.2% nitrogen; and vi) 0 to about 32% iron; and c) activating the anode and the counter electrode with an electrolyte.

9. The method of claim 8 including providing at least one of molybdenum and tungsten in the alloy in an amount such that the sum of chromium, molybdenum and tungsten is about 27%, by weight percent, or greater.

10. The method of claim 8 including providing the alloy comprising greater than about 2.0%, by weight percent, of either molybdenum or tungsten, and mixtures thereof.

11. The method of claim 8 wherein the anode is lithium, the electrode active material of the counter electrode is fluorinated carbon and the electrolyte is $LiBF_4$ in γ-butyrolactone.

12. A current collector for use in an electrical energy storage device, the current collector of an alloy comprising, by weight percent:

a) at least about 28% cobalt;

b) about 33% to about 47% nickel;

c) about 19% to 27.5% chromium;

d) at least one of molybdenum and tungsten in an amount such that the sum of chromium, molybdenum and tungsten is at least about 25%;

e) about 0.01% to about 1% titanium;

f) 0 to about 0.2% nitrogen; and g) 0 to about 32% iron.

13. The current collector of claim 12 wherein at least one of molybdenum and tungsten is present in the alloy in an amount such that the sum of chromium, molybdenum and tungsten is about 27%, by weight percent, or greater.

14. The current collector of claim 12 wherein the alloy comprises greater than about 2.0%, by weight percent, of either molybdenum or tungsten, and mixtures thereof.

15. The current collector of claim 12 wherein the alloy further comprises minor amounts of at least one element selected from the group consisting of silicon, phosphorus, sulfur, titanium, aluminum, tantalum, zirconium, lanthium, boron, beryllium, manganese, and mixtures thereof.

16. A current collector for use in an electrical energy storage device, the current collector of an alloy comprising, by weight percent:

a) about 28% to about 40% cobalt;

b) about 33% to about 37% nickel;

c) about 19% to 21% chromium;

d) about 9% to about 11% molybdenum;

e) 0.01% to about 1.1% iron;

f) 0.01% to about 1% titanium; and wherein the sum of manganese, silicon and carbon is in an amount less than or equal to about 0.5%.

17. The current collector of claim 16 wherein the alloy further comprises minor amounts of either phosphorous or sulfur, and mixtures thereof.

18. An electrochemical cell, which comprises:

a) an anode;

b) a counter electrode comprising at least one electrode active material supported on a current collector, wherein, by weight percent, the current collector is of an alloy comprising:

i) at least about 28% cobalt;

ii) about 33% to about 47% nickel;

iii) about 19% to 27.5% chromium;

iv) at least one of molybdenum and tungsten in an amount such that the sum of chromium, molybdenum and tungsten is at least about 25%;

v) about 0.01% to about 1% titanium;

vi) 0 to about 0.2% nitrogen; and vii) 0 to about 32% iron; and c) an electrolyte activating the anode and the counter electrode.

19. The electrochemical cell of claim 18 wherein at least one of molybdenum and tungsten is present in the alloy in an amount such that the sum of chromium, molybdenum and tungsten is about 27%, by weight percent, or greater.

20. The electrochemical cell of claim 18 wherein the alloy comprises greater than about 2.0%, by weight percent, of either molybdenum or tungsten, and mixtures thereof.

21. The electrochemical cell of claim 18 wherein the anode is lithium, the electrode active material of the counter electrode is fluorinated carbon and the electrolyte is $LiBF_4$ in γ-butyrolactone.

22. An electrochemical cell, which comprises:

a) an anode;

b) a counter electrode comprising at least one electrode active material supported on a current collector, wherein, by weight percent, the current collector is of an alloy comprising:

i)about 45% to about 57% cobalt;

ii)about 19% to about 21% chromium;

iii)about 9% to about 11% nickel;

iv)about 14% to about 16% tungsten;

v)about 0% to about 3% iron;

vi)about 1% to about 2% manganese; and wherein the sum of silicon and carbon is in an amount less than or equal to about 0.60%; and d) an electrolyte activating the anode and the counter electrode.

23. The electrochemical cell of claim 22 wherein the anode is lithium and the electrode active material of the counter electrode is fluorinated carbon.

24. The electrochemical cell of claim 22 wherein the electrolyte is $LiBF_4$ in γ-butyrolactone.

25. The electrochemical cell of claim 6 wherein the electrolyte is $LiBF_4$ in γ-butyrolactone.

* * * * *

UNITED STATES PATENT AND TRADEMARK OFFICE

CERTIFICATE OF CORRECTION

PATENT NO. : 6,541,158 B2
DATED : April 1, 2003
INVENTOR(S) : Frysz et al.

It is certified that error appears in the above-identified patent and that said Letters Patent is hereby corrected as shown below:

Column 16,
Line 28, "d)" should be -- c) --

Signed and Sealed this

Eighth Day of July, 2003

JAMES E. ROGAN
*Director of the United States Patent and Trademark Office*